US012736049B1

(12) United States Patent
Kumar et al.

(10) Patent No.: US 12,736,049 B1
(45) Date of Patent: Sep. 15, 2026

(54) FRAC PUMP AND CONNECTION ASSEMBLY FOR FRAC PUMP

(71) Applicant: SPM Oil & Gas Inc., Fort Worth, TX (US)

(72) Inventors: Chandu Kumar, Fort Worth, TX (US); Mark J. Carls, Seymour, TN (US); Ralph Harris, Ft Worth, TX (US); John Marquez, Saginaw, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 0 days.

(21) Appl. No.: 19/267,777

(22) Filed: Jul. 14, 2025

(51) Int. Cl.
*F04B 53/16* (2006.01)
*E21B 43/26* (2006.01)

(52) U.S. Cl.
CPC ..... *F04B 53/16* (2013.01); *E21B 43/2607* (2020.05)

(58) Field of Classification Search
CPC ..... F04B 39/121; F04B 39/122; F04B 53/16; F04B 53/22; E21B 43/2607
USPC ..... 123/90.38, 195 S, 198 E
See application file for complete search history.

(56) References Cited

U.S. PATENT DOCUMENTS

| | | | | |
|---|---|---|---|---|
| 9,976,544 | B2 | 5/2018 | Morreale | |
| 10,871,227 | B1 | 12/2020 | Belshan et al. | |
| 11,168,676 | B2 * | 11/2021 | Lesko | F04B 53/08 |
| 12,158,143 | B2 | 12/2024 | Graham et al. | |
| 2019/0178243 | A1 * | 6/2019 | Nowell | F04B 53/007 |
| 2019/0226477 | A1 * | 7/2019 | Stokkevåg | F04B 53/22 |

* cited by examiner

*Primary Examiner* — Kenneth J Hansen

(57) ABSTRACT

A connection assembly for a frac pump includes a stay rods extending between a fluid end and a power end to removably connect the fluid end with the power end. The connection assembly also includes a first side plate disposed at a first end and extends between the fluid end and the power end. The first side plate is removably coupled with one or more stay rods from the plurality of stay rods that are disposed proximal to the first end. The connection assembly further includes a second side plate disposed at a second end and longitudinally opposite the first end. The second side plate extends between the fluid end and the power end. The second side plate is removably coupled with one or more stay rods from the plurality of stay rods that are disposed proximal to the second end.

20 Claims, 7 Drawing Sheets

FRAC PUMP AND CONNECTION ASSEMBLY FOR FRAC PUMP

TECHNICAL FIELD

The present disclosure relates to a frac pump, and more particularly, to a connection assembly for the frac pump.

BACKGROUND

A frac pump is typically used for hydraulic fracking or other high-pressure applications in which a high-pressure fluid is injected downhole to fracture, for example, a subterranean rock. The frac pump includes a power end and a fluid end that is removably connected to the power end via a plurality of stay rods. The fluid is pumped by the fluid end by a plurality of plungers of the fluid end. One or more gears in the power end drives the plungers to generate pressure in the fluid end.

Further, when the frac pump is in operation, a flange of the fluid end and the stay rods are subjected to a large amount of stresses and fatigues due to various factors like duty cycle changes, stiffer trailer configurations, higher demand and longer frac stages, and so on. In some cases, the flange of the fluid end may deflect causing uneven load sharing in the stay rods, thereby leading to bending stress in the stay rods. Specifically, the stay rods that are disposed proximal to the ends of the frac pump are subjected to more stresses compared to the stay rods that are disposed between the end stay rods. If the flanges and/or the stay rods are subjected to continued and uneven stresses they may eventually fail and may have to be repaired or replaced, thereby increasing an overall cost of the frac pump.

U.S. Publication Number 2019/0226477 describes a pump that includes a power end, and a fluid end. A sliding plate extends from the power end, and a distal end of the sliding plate has engaging structure. The fluid end has complementary engaging structure for slidably mating with the engaging structure as the fluid end is raised or lowered relative to the power end. A locking plate is provided for preventing disengagement of the complementary engaging structure and the engaging structure.

SUMMARY OF THE DISCLOSURE

In an aspect of the present disclosure, a connection assembly for a frac pump is provided. The connection assembly includes a plurality of stay rods extending between a fluid end of the frac pump and a power end of the frac pump to removably connect the fluid end with the power end. The connection assembly also includes a first side plate disposed at a first end of the frac pump. The first side plate extends between the fluid end and the power end. The first side plate is removably coupled with one or more stay rods from the plurality of stay rods that are disposed proximal to the first end. The connection assembly further includes a second side plate disposed at a second end of the frac pump. The second end is longitudinally opposite the first end. The second side plate extends between the fluid end and the power end. The second side plate is removably coupled with one or more stay rods from the plurality of stay rods that are disposed proximal to the second end.

In another aspect of the present disclosure, a frac pump is provided. The frac pump includes a power end. The frac pump also includes a fluid end. The frac pump further includes a connection assembly that removably connects the fluid end with the power end. The connection assembly includes a plurality of stay rods extending between the fluid end and the power end to removably connect the fluid end with the power end. The connection assembly also includes a first side plate disposed at a first end of the frac pump. The first side plate extends between the fluid end and the power end. The first side plate is removably coupled with one or more stay rods from the plurality of stay rods that are disposed proximal to the first end. The connection assembly further includes a second side plate disposed at a second end of the frac pump. The second end is longitudinally opposite the first end. The second side plate extends between the fluid end and the power end. The second side plate is removably coupled with one or more stay rods from the plurality of stay rods that are disposed proximal to the second end.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
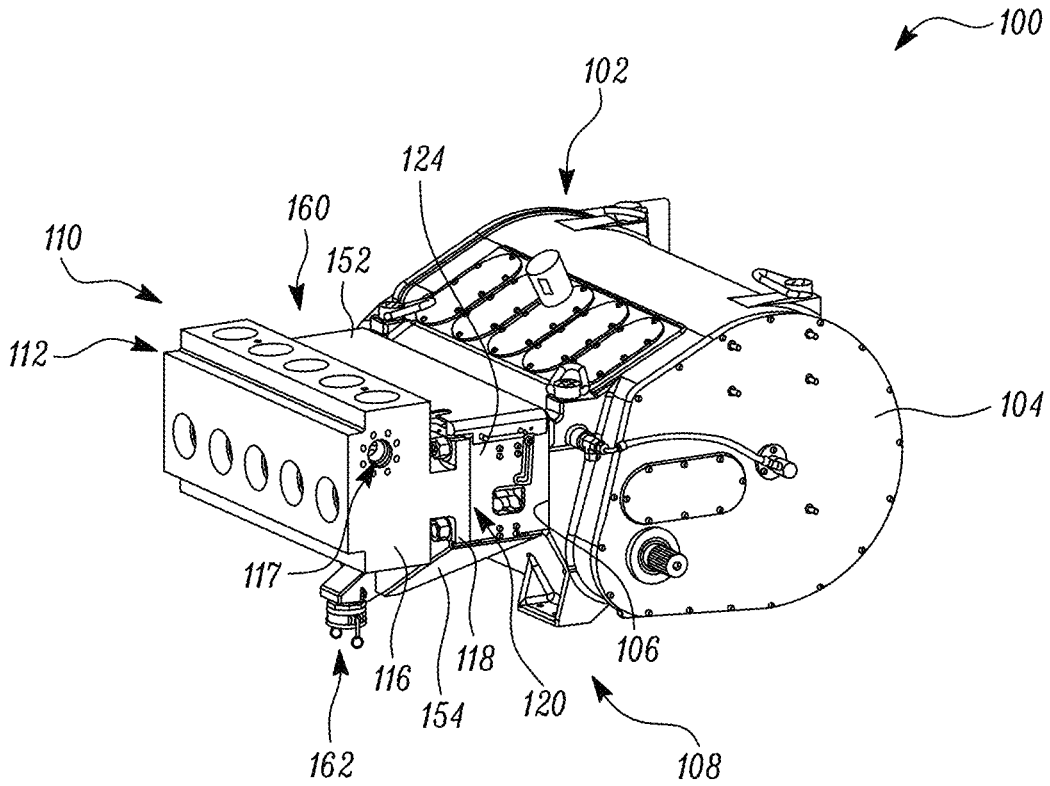
FIG. 1 is a perspective view of a frac pump, according to an example of the present disclosure.

Referring to FIG. 1, a perspective view of a frac pump 100 is illustrated. The frac pump 100 is also known as fracturing pump or fracking pump. The frac pump 100 is usable in oil and gas industry, primarily during hydraulic fracking operations, for example, to extract oil and natural gas from a subterranean rock by injecting a high-pressure mixture (fracturing fluid) of water, sand, and chemicals into a wellbore. The frac pump 100 pumps the fracturing fluid needed for the hydraulic fracking operations.

The frac pump 100 defines a first end 108 and a second end 110 longitudinally opposite the first end 108. The frac pump 100 also defines a top end 160 and a bottom end 162 vertically opposite the top end 160.

The frac pump 100 includes a power end 102. The power end 102 couples with a power source, such as an engine (not shown) and/or a motor (not shown) that drives the frac pump 100. The power end 102 includes a gearbox (not shown) and a crankshaft (not shown) to convert the power from the power source into a mechanical energy of plungers 114 needed to drive the frac pump 100. Further, the power end 102 of the frac pump 100 converts mechanical power into a hydraulic force necessary to pump the fracturing fluid. The power end 102 also provides a necessary torque to drive the frac pump 100 at high speeds. The power end 102 includes a housing 104. Various components of the power end 110 are disposed within the housing 104. The power end 102 also includes a mounting portion 106. The housing 104 defines the mounting portion 106.

The frac pump 100 further includes a fluid end 112. The fluid end 112 is a section of the frac pump 100 that interacts directly with the fracturing fluid and is also responsible for generating high pressure that is required to inject the fracturing fluid into the wellbore during the hydraulic fracking operations. The fluid end 112 includes a fluid end body 116. The fluid end 112 also includes a flange 118. Specifically, the flange 118 is disposed at an end of the fluid end 112 that is proximal to (e.g., facing towards) the power end 102. As shown, a surface of the flange 118 facing the power end 102 is flat. However, in some other embodiments, the surface of the flange 118 facing the power end 102 is not flat. For example, certain portions of the surface (e.g., mid portions closer to a vertical centerline) may extend further in the direction of the power end compared to remaining portions of the surface (e.g., portions surrounding the stay rods 122). For example, in other terms, portions of the surface surrounding the stay rods 122 may be recessed compared to the mid portions of the surface.

Figure 5:
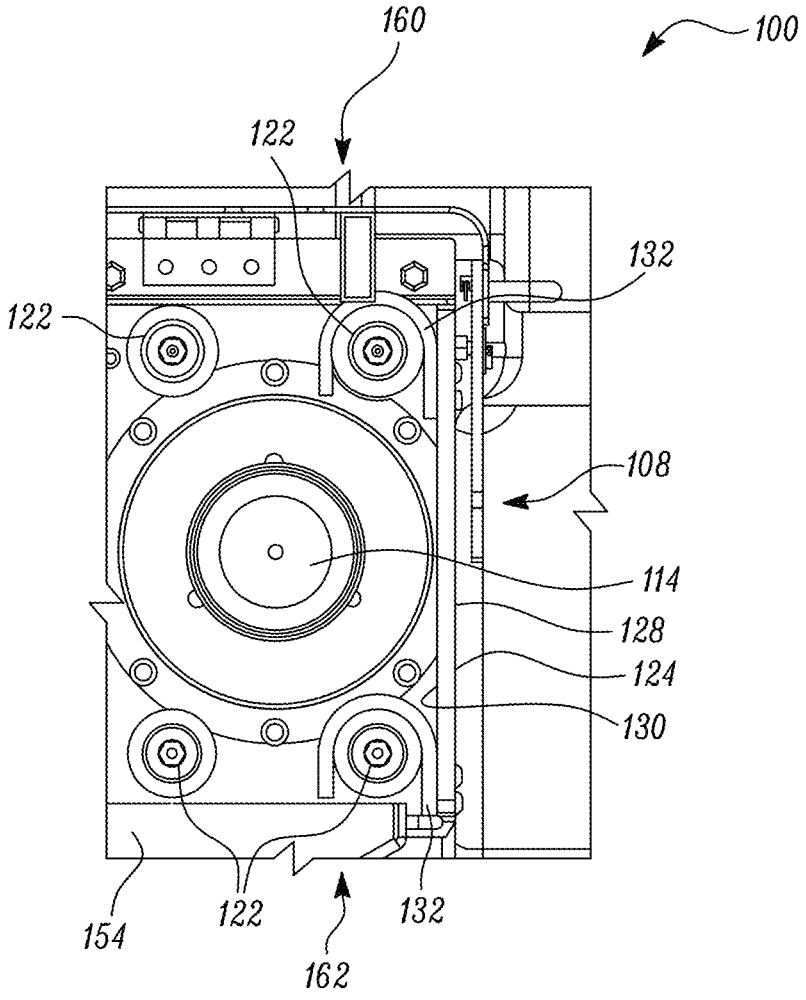
FIG. 5 is a side view of the connection assembly of FIG. 3.

The fluid end 112 further includes a plurality of plungers 114 (shown in FIG. 5). The plungers 114 perform the function of drawing the fracturing fluid into the frac pump 100 and then displacing it at the high pressure into the wellbore. The fluid end 112 includes a plurality of valves (not shown) that control direction of a flow and regulate the pressure of the fracturing fluid. The valves include suction valves and discharge valves. The fluid end 112 further includes a fluid end manifold (not shown) coupled with the fluid end 112 for distributing the fracturing fluid to different sections of the fluid end 112.

Further, the fluid end 112 includes a discharge port 117 used to direct the fracturing fluid from the fluid end 112 towards the wellbore during the hydraulic fracking operations.

Figure 2:
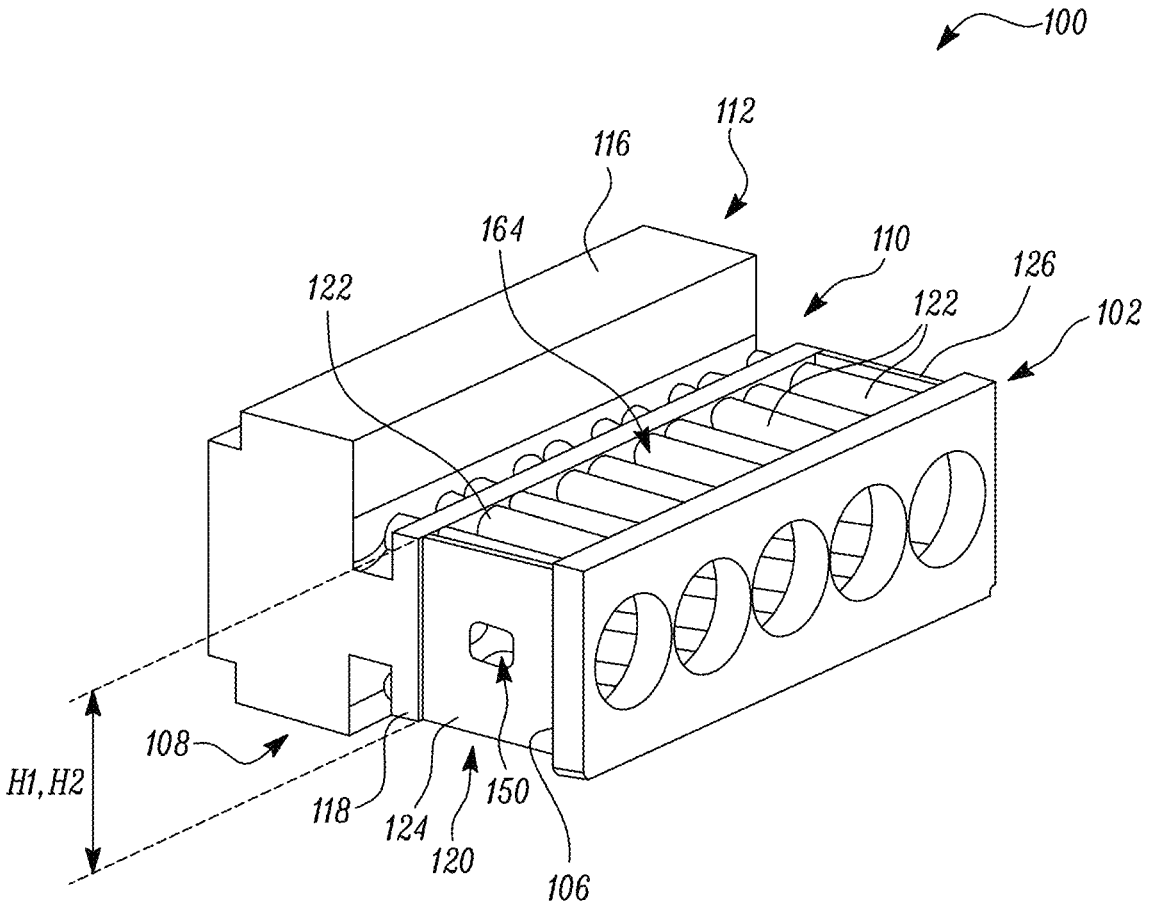
FIG. 2 is a perspective view of a portion of the frac pump of FIG. 1.

The present disclosure relates to a connection assembly 120 for the frac pump 100. The frac pump 100 includes the connection assembly 120 that removably connects the fluid end 112 with the power end 102. With reference to FIG. 2, the connection assembly 120 includes a plurality of stay rods 122 extending between the fluid end 112 and the power end 102 to removably connect the fluid end 112 with the power end 102.

The stay rods 122 support and stabilize the frac pump 100 during the hydraulic fracking operations. The stay rods 122 are subjected to large stresses that are generated during the hydraulic fracking operations. The stay rods 122 also maintains an alignment and integrity of the power end 102 and the fluid end 112 with each other. The stay rods 122 may be made of alloy steel, hardened steel, chromed or coated materials, and the like, without limiting the scope of the present disclosure.

The stay rods 122 are removably coupled with the flange 118 to removably connect the fluid end 112 with the power end 102. Further, the stay rods 122 are removably coupled with the mounting portion 106 to removably connect the fluid end 112 with the power end 102.

Specifically, each stay rod 122 is connected, at a first end, to the mounting portion 106 of the power end 102 and, at a second opposite end, with the flange 118 of the fluid end 112. In some examples, the stay rods 122 may be connected to the mounting portion 106 and/or the flange 118 using any known fastening means, such as, bolts, pins, screws, rivets, and the like.

In the illustrated example of FIG. 2, the stay rods 122 are circular in shape. However, the stay rods 122 may have another shape, as per application requirements.

Figure 3:
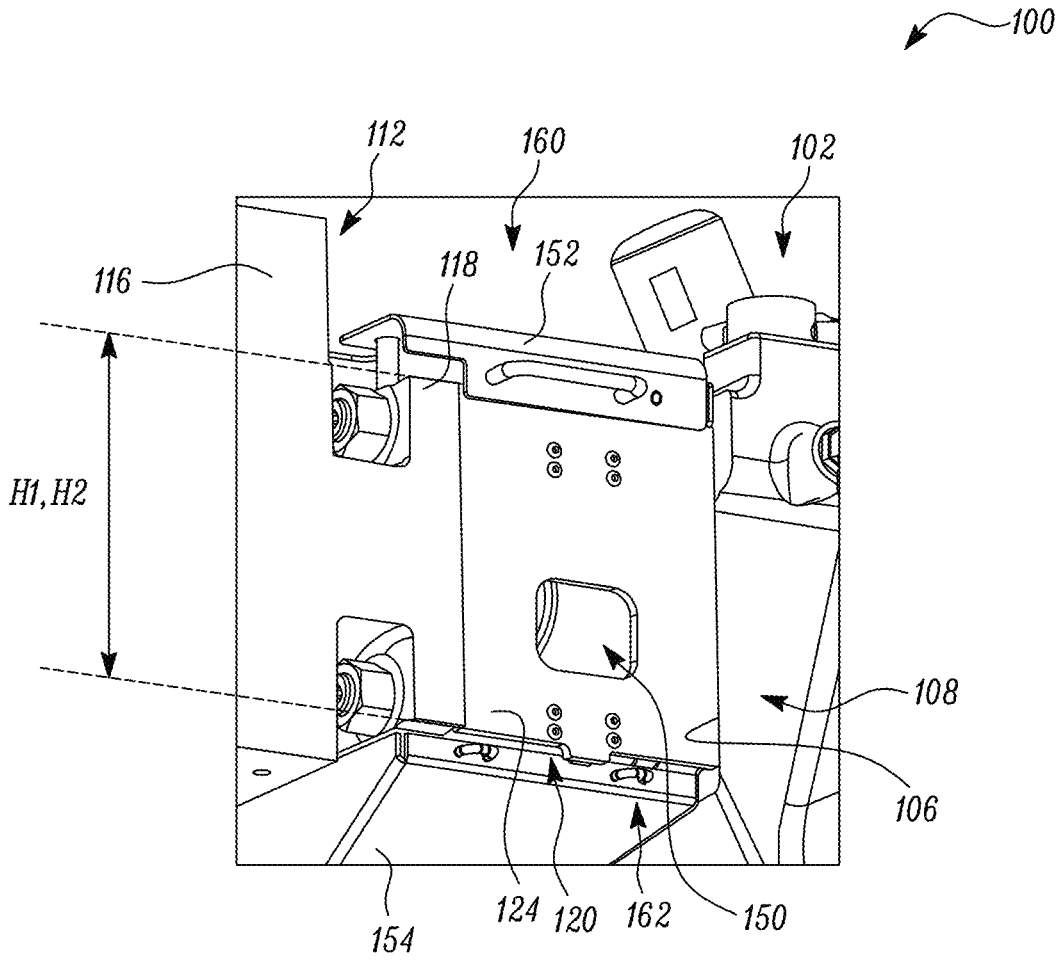
FIG. 3 is a perspective view of a connection assembly of the frac pump of FIG. 1, according to an example of the present disclosure.

With reference to FIGS. 1 to 3, the connection assembly 120 also includes a first side plate 124 disposed at the first end 108 of the frac pump 100. The first side plate 124 extends between the fluid end 112 and the power end 102. Further, the first side plate 124 is engaged with the flange 118 of the fluid end 112 and the mounting portion 106 of the power end 102 at the first end 108 of the frac pump 100. In some embodiments, as shown, the first side plate 124 may be in contact with the flange 118 along an entire height of the flange 118. In some other embodiments, such as when the surface of the flange 118 facing the power end 102 is not flat, only a portion of the first side plate 124 (e.g., a vertical mid portion) may be in contact with the flange 118. For example, upper and lower portions of the first side plate 124 may be not in contact with the flange 118. A compression force, resulting from the stay rods 122 between the flange 118 and the mounting portion 106, holds the first side plate 124 in place. The first side plate 124 is also removably coupled with one or more stay rods 122, of the stay rods 122, that are disposed proximal to the first end 108.

Referring now to FIG. 2, the connection assembly 120 further includes a second side plate 126 disposed at the second end 110 of the frac pump 100. The second side plate 126 is similar in design and dimensions to the first side plate 124. The second side plate 126 extends between the fluid end 112 and the power end 102. Further, the second side plate 126 is engaged with the flange 118 of the fluid end 112 and the mounting portion 106 of the power end 102 at the second end 110 of the frac pump 100. In some embodiments, as shown, the second side plate 126 may be in contact with the flange 118 along an entire height of the flange 118. In some other embodiments, such as when the surface of the flange 118 facing the power end 102 is not flat, only a portion of the second side plate 126 (e.g., a vertical mid portion) may be in contact with the flange 118. For example, upper and lower portions of the second side plate 126 may be not in contact with the flange 118. The compression force between the flange 118 and the mounting portion 106 holds the second side plate 126 in place. The second side plate 126 is also removably coupled with one or more stay rods 122, of the stay rods 122, that are disposed proximal to the second end 110. In some embodiments, the assembled frac pump 100 may include one and only one side plate 124/126. Relying on one and only one side plate 124/126 can provide the advantages described herein. However, utilizing a pair of side plates 124, 126 with one side plate 124, 126 at each end 108, 110 of the frac pump 100, as illustrated, can provide additional advantages related to stress distribution, cyclic loading, and dynamic strain across the stay rods 122 during operation of the frac pump 100.

Figure 4:
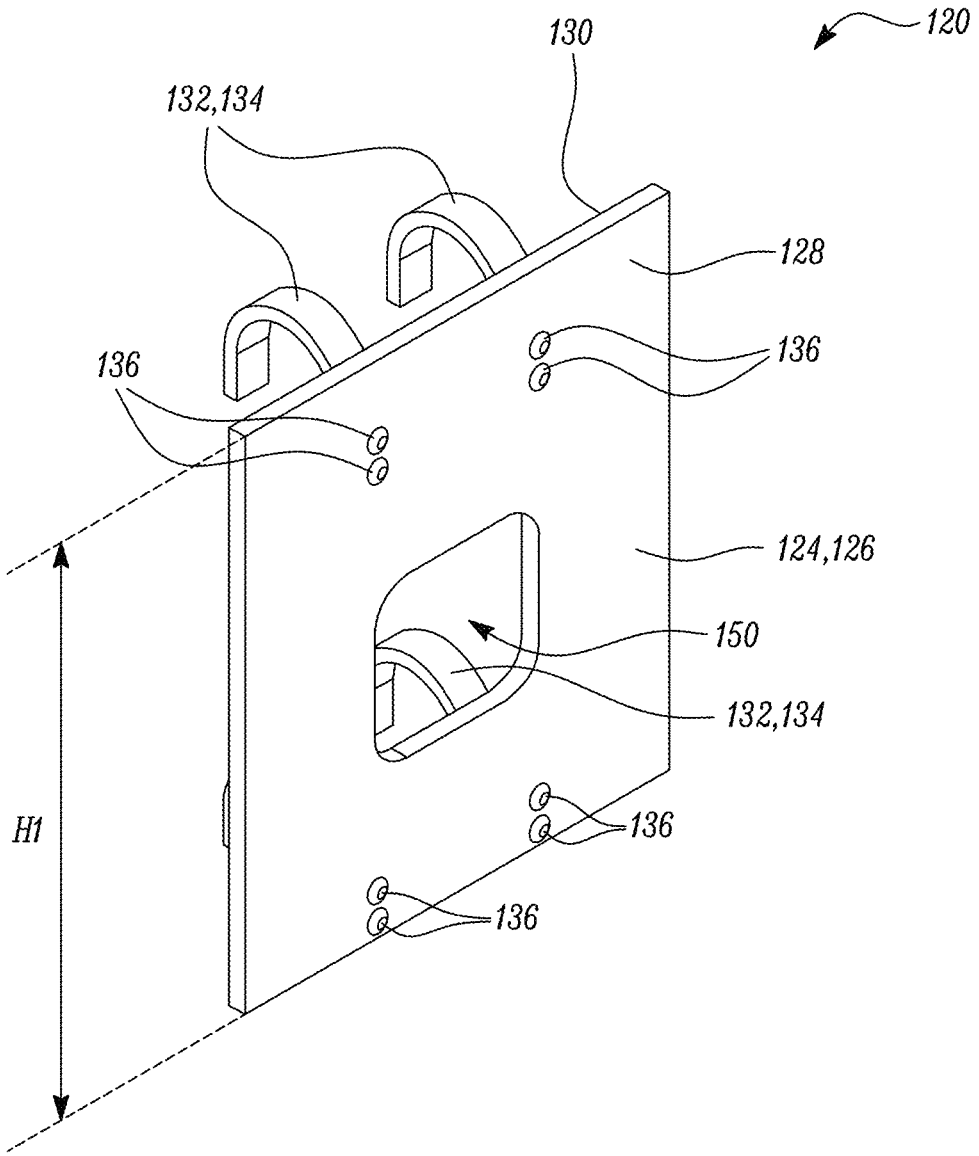
FIG. 4 is a perspective view of a side plate of the connection assembly of FIG. 3, according to an example of the present disclosure.

Referring to FIG. 4, a perspective view of the first and second side plates 124, 126 of the connection assembly 120 is illustrated. As shown in FIG. 4, each of the first side plate 124 and the second side plate 126 defines a height H1. In some examples, the height H1 of each of the first side plate 124 and the second side plate 126 is substantially equal to a height H2 (shown in FIGS. 2 and 3) of the flange 118 of the fluid end 112. Further, each of the first side plate 124 and the second side plate 126 has one of a rectangular shape or a square shape. In the illustrated example of FIG. 4, each of the first side plate 124 and the second side plate 126 has a rectangular shape.

Each of the first side plate 124 and the second side plate 126 defines a first surface 128 and a second surface 130 opposite the first surface 128. Specifically, the second surface 130 of each of the first side plate 124 and the second side plate 126 faces the stay rods 122 (see FIG. 5). In some embodiments, the first surface 128 is flush, or substantially flush, with a surface, or portion of a surface, associated with, or partially defining, the first or second end 108, 110 (e.g., of the power end 102 or fluid end 112) of the frac pump 100. In some other embodiments, a portion of the first and/or second side plate 124, 126 is overlapping with a surface, or portion of a surface, associated with, or partially defining, the first or second end 108, 110 (e.g., of the power end 102 or fluid end 112) of the frac pump 100.

Referring to FIGS. 3, 4, and 5, the first side plate 124 includes one or more first coupling extensions 132 coupled with the second surface 130 of the first side plate 124. Each of the one or more first coupling extensions 132 engage with the one or more stay rods 122 that are disposed proximal to the first end 108 to removably couple the first side plate 124 with the one or more stay rods 122. In some embodiments, each side plate 124, 126 may include one and only one coupling extension 132 to be coupled with a single stay rod 122. Relying on one and only one coupling extension 132 for each side plate 124, 126 can provide the advantages described herein. However, utilizing more than one coupling extension 132 for each side plate 124, 126 can provide additional connection integrity, stability, and positioning advantages during attachment of the side plates 124, 126 and/or operation of the frac pump 100.

In the illustrated example of FIGS. 3, 4, and 5, the one or more first coupling extensions 132 include four first coupling extensions 132. In some examples, the one or more first coupling extensions 132 may include three first coupling extensions 132, five first coupling extensions 132, and the like, without limiting the scope of the present disclosure.

Further, each of the four first coupling extensions 132 has an arcuate shape. Specifically, each of the four first coupling extensions 132 are U-shaped. However, the four first coupling extensions 132 may have any desired shape, as per the shape of the stay rods 122.

Further, the one or more first coupling extensions 132 may be coupled with the first side plate 124 via one or more fasteners 136. In the illustrated example of FIGS. 3, 4, and 5, each first coupling extension 132 from the one or more first coupling extensions 132 is coupled with the first side plate 124 via two fasteners 136. In some examples, the fasteners 136 may include rivets, bolts, screws, pins, and the like. Alternatively, the one or more first coupling extensions 132 may be coupled with the first side plate 124 via welding, soldering, or brazing.

One pair of the first coupling extensions 132 from the four first coupling extensions 132 engage with a single stay rod 122, of the two stay rods 122, that is disposed proximal to the first end 108. Another pair of the first coupling extensions 132 from the four first coupling extensions 132 engage with another stay rod 122, of the two stay rods 122, that is disposed proximal to the first end 108.

Referring to FIGS. 2 and 4, the second side plate 126 includes one or more second coupling extensions 134 coupled with the second surface 130 of the second side plate 126. Each of the one or more second coupling extensions 134 engage with the one or more stay rods 122 that are disposed proximal to the second end 110 to removably couple the second side plate 126 with the one or more stay rods 122.

In the illustrated example of FIGS. 2 and 4, the one or more second coupling extensions 134 include four second coupling extensions 134. In some examples, the one or more second coupling extensions 134 may include three second coupling extensions 134, five second coupling extensions 134, and the like, without limiting the scope of the present disclosure.

Further, each of the four second coupling extensions 134 has an arcuate shape. Specifically, each of the four second coupling extensions 134 are U-shaped. However, the four second coupling extensions 134 may have any desired shape, as per the shape of the stay rods 122.

Further, the one or more second coupling extensions 134 are coupled with the second side plate 126 via one or more fasteners 136. Each second coupling extension 134 from the one or more second coupling extensions 134 is coupled with the second side plate 126 via two fasteners 136. In some examples, the fasteners 136 may include rivets, bolts, screws, pins, and the like. Alternatively, the one or more second coupling extensions 134 may be coupled with the second side plate 126 via welding, soldering, or brazing.

One pair of the second coupling extensions 134 from the four second coupling extensions 134 engage with a single stay rod 122, of the two stay rods 122, that is disposed proximal to the second end 110. Another pair of the second coupling extensions 134 from the four second coupling extensions 134 engage with another stay rod 122, of the two stay rods 122, that is disposed proximal to the second end 110.

Referring to FIGS. 3 and 4, each of the first side plate 124 and the second side plate 126 defines a through-opening, or window, 150 to provide visual access to a space 164 (shown in FIG. 2) defined between the first side plate 124 and the second side plate 126. In the illustrated example of FIGS. 3 and 4, the through-opening 150 is rectangular in shape. In some examples, the through-opening 150 may be square in shape, circular in shape, triangular in shape, and the like, without limiting the scope of the present disclosure.

In the illustrated example of FIGS. 3 and 4, the through-opening 150 is disposed proximal to the bottom end 162 of the frac pump 100. In some examples, the through-opening 150 may be disposed proximal to the top end 160. Alternatively, the through-opening 150 may be centrally disposed between the top end 160 and the bottom end 162.

With reference to FIGS. 1 and 3, the frac pump 100 further includes a first cover plate 152 disposed proximal to the top end 160 of the frac pump 100. Specifically, the first cover plate 152 is disposed just above the connection assembly 120. Further, the frac pump 100 includes a second cover plate 154 disposed proximal to the bottom end 162 of the frac pump 100. Specifically, the second cover plate 154 is disposed just below the connection assembly 120. Each of the first cover plate 152 and the second cover plate 154 may isolate the stay rods 122, the plunger 114, and other components of the frac pump 100 from dust, dirt, leakage, and the like.

Figure 6:
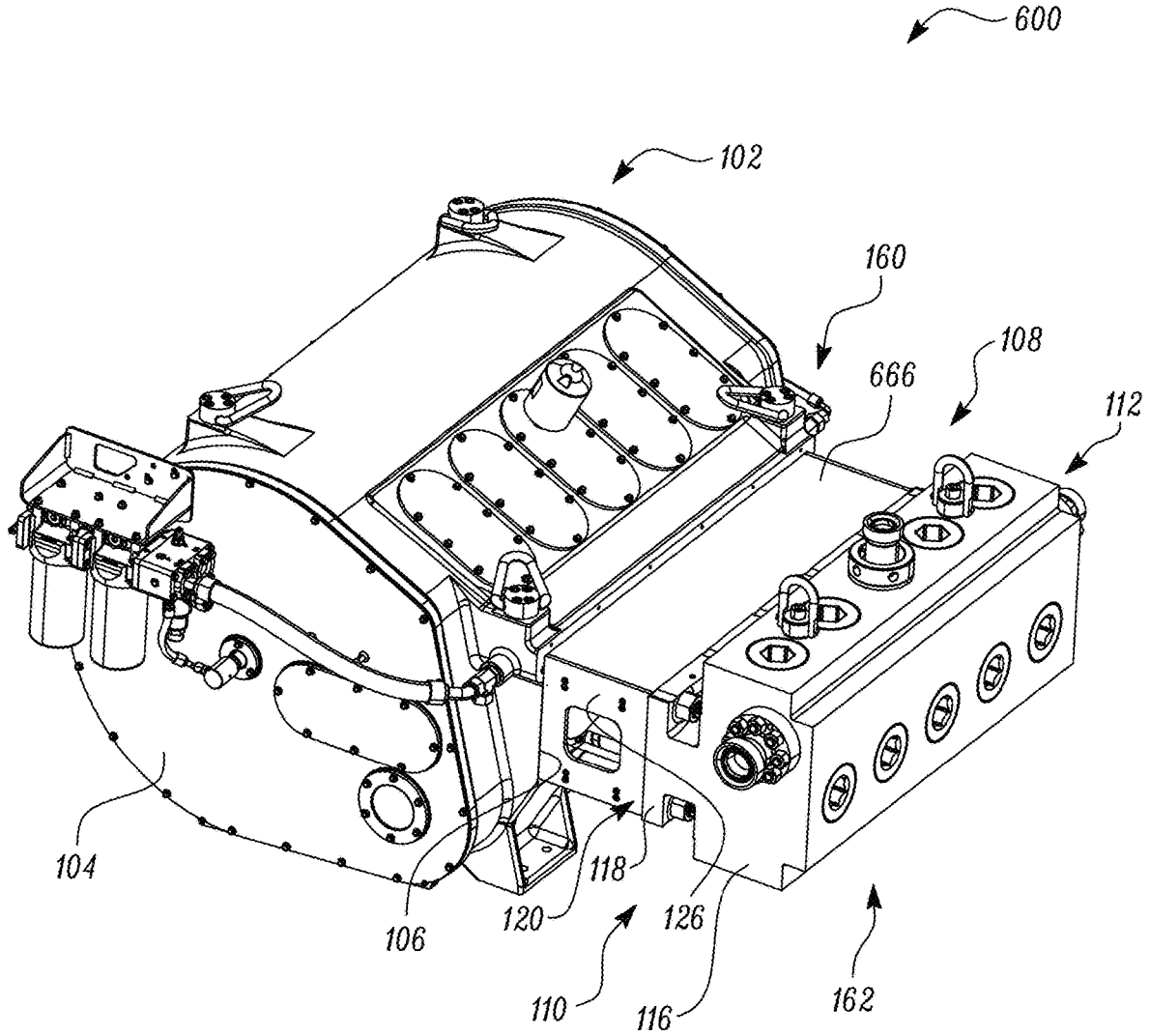
FIGS. 6 and 7 are perspective views of a frac pump, according to another example of the present disclosure.
Figure 7:
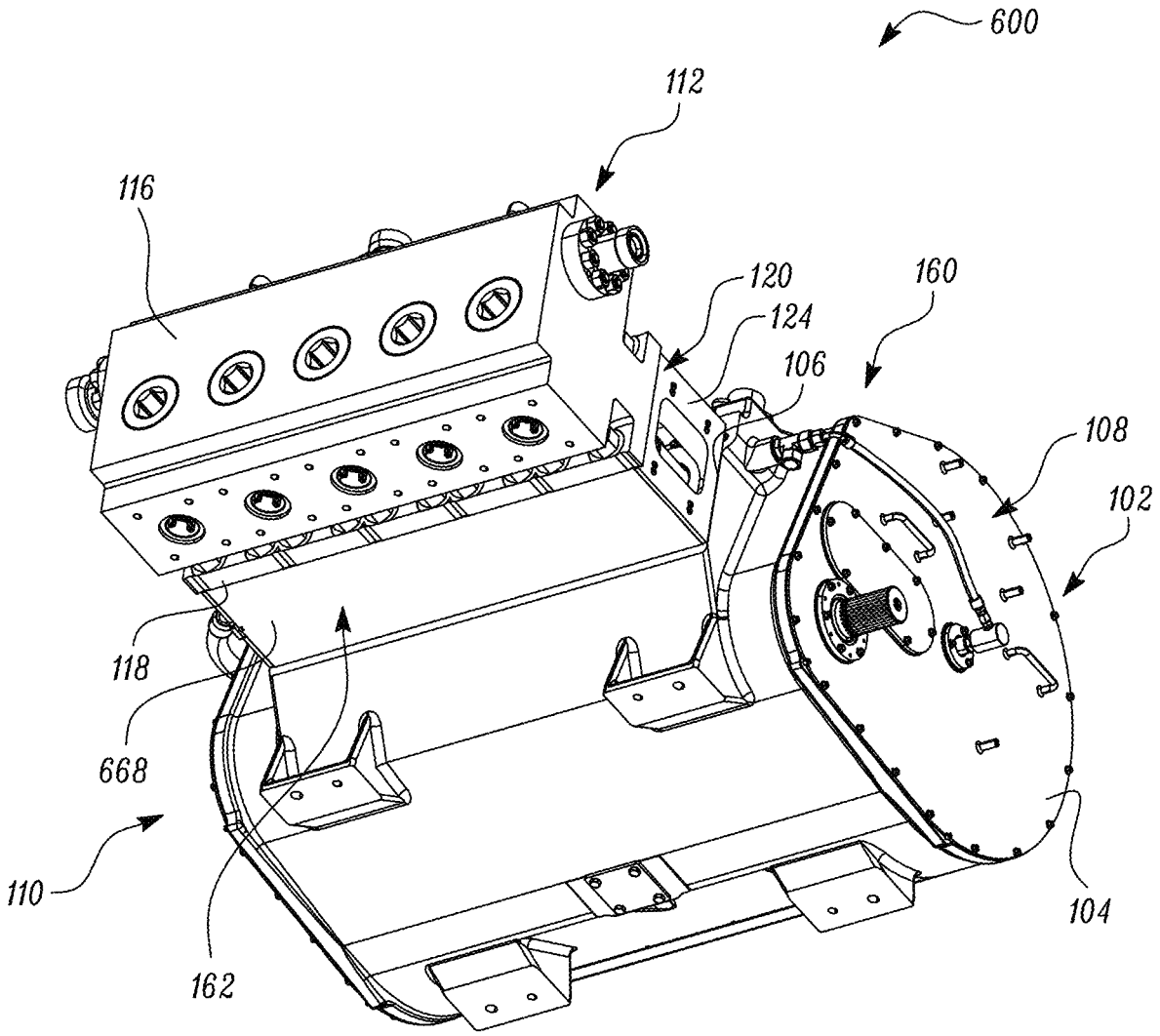

FIGS. 6 and 7 illustrate a frac pump 600, according to another embodiment of the present disclosure. The frac pump 600 is similar to the frac pump 100 (shown in FIGS. 1 to 5), with common components referred to by the same numeral.

As shown in FIG. 6, the frac pump 600 includes the first side plate 124 (see FIG. 7) and the second side plate 126. In addition to the first side plate 124 and the second side plate 126, the frac pump 600 also includes a top plate 666. The top plate 666 is disposed at the top end 160 of the frac pump 600. The top plate 666 extends between the fluid end 112 and the power end 102. Further, the top plate 666 is engaged with the flange 118 of the fluid end 112 and the mounting portion 106 of the power end 102 at the top end 160. The compression force, resulting from the stay rods 122 (see FIG. 5) between the flange 118 and the mounting portion 106, holds the top plate 666 in place. The top plate 666 may also be removably coupled with one or more stay rods 122, of the stay rods 122, that are disposed proximal to the top end 160, or the top plate 666 may be fixedly coupled with flange 118 and the mounting portion 106.

Moreover, as shown in FIG. 7, the frac pump 600 further includes a bottom plate 668. The bottom plate 668 is disposed at the bottom end 162 of the frac pump 600. The bottom plate 668 extends between the fluid end 112 and the power end 102. Further, the bottom plate 668 is engaged with the flange 118 of the fluid end 112 and the mounting portion 106 of the power end 102 at the bottom end 162. The compression force, resulting from the stay rods 122 (see FIG. 5) between the flange 118 and the mounting portion 106, holds the bottom plate 668 in place. The bottom plate 668 may also be removably coupled with one or more stay rods 122, of the stay rods 122, that are disposed proximal to the bottom end 162, or the bottom plate 668 may be fixedly coupled with flange 118 and the mounting portion 106. The bottom plate 668 is similar in design and dimensions to the top plate 666 (see FIG. 6). The top and bottom plates 666, 668 are rectangular in shape.

Referring to FIGS. 6 and 7, in some embodiments, the frac pump 600 may include only one of the top and bottom plates 666, 668. Relying on only one of the top and bottom plates 666, 668 can provide the advantages described herein. However, utilizing each of the top and bottom plates 666, 668 at each of the top and bottom ends 160, 162 of the frac pump 600, as illustrated, can provide additional advantages related to stress distribution, cyclic loading, and dynamic strain across the stay rods 122 during an operation of the frac pump 600.

It is to be understood that individual features shown or described for one embodiment may be combined with individual features shown or described for another embodiment. The above-described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the connection assembly 120 for the frac pump 100, 600. The connection assembly 120 includes the stay rods 122 removably coupled with the flange 118 and the mounting portion 106 to removably connect the fluid end 112 with the power end 102. The connection assembly 120 also includes the first side plate 124 disposed at the first end 108 and the second side plate 126 disposed at the second end 110. Each of the first side plate 124 and the second side plate 126 acts as a brace plate disposed between the power end 102 and the fluid end 112. The first side plate 124 is removably coupled with one or more stay rods 122 that are disposed proximal to the first end 108 and the second side plate 126 is removably coupled with one or more stay rods 122 that are disposed proximal to the second end 110.

The first side plate 124 and the second side plate 126 may allow uniform distribution of stresses, that are generated during the hydraulic fracking operations, across the stay rods 122. This phenomenon may prevent bending/failure of the stay rods 122 disposed proximal to the first and second ends 108, 110. Specifically, the first and second side plates 124, 126 may limit and distribute cyclic loading among the stay rods 122 for improved sharing of load. Further, the first and second side plates 124, 126 may reduce dynamic strains in the stay rods 122. The first and second side plates 124, 126 may also reduce bending/failure of the flange 118.

In some embodiments, the frac pump 600 may also include the top and/or bottom plates 666, 668 in addition to the first and second side plates 124, 126. The top and/or bottom plates 66, 668 may also prevent bending/failure of the stay rods 122, may limit and distribute cyclic loading among the stay rods 122 for improved sharing of load, may reduce dynamic strains in the stay rods 122, and may also reduce bending/failure of the flange 118.

Moreover, each of the first side plate 124 and the second side plate 126 defines the through-opening 150 to provide visual access to the space 164 defined between the first side plate 124 and the second side plate 126. The through-opening 150 may simplify a maintenance/servicing of the frac pump 100, 600, and may also allow passage of any heat that may be generated between the fluid end 112 and the power end 102 during hydraulic fracking operations. Further, the through-opening 150 may allow operators to monitor a movement of the plunger 114 and any leakage from the frac pump 100, 600.

Overall, the connection assembly 120 may be simple in construction, may be easy to manufacture, may be cost-effective, and may be durable. Further, the connection assembly 120 may be retrofitted on existing frac pumps. Moreover, the connection assembly 120 may be used on a variety of frac pumps.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

The invention claimed is:

1. A connection assembly for a frac pump, the connection assembly comprising:

a plurality of stay rods extending between a fluid end of the frac pump and a power end of the frac pump to removably connect the fluid end with the power end;

a first side plate disposed at a first end of the frac pump, wherein the first side plate extends between the fluid end and the power end, and wherein the first side plate is removably coupled with one or more stay rods, of the plurality of stay rods, that are disposed proximal to the first end; and a second side plate disposed at a second end of the frac pump, wherein the second end is longitudinally opposite the first end, wherein the second side plate extends between the fluid end and the power end, and wherein the second side plate is removably coupled with one or more stay rods, of the plurality of stay rods, that are disposed proximal to the second end.

2. The connection assembly of claim 1, wherein the fluid end includes a flange, and wherein the plurality of stay rods are removably coupled with the flange to removably connect the fluid end with the power end, wherein the power end includes a mounting portion, wherein the plurality of stay rods are removably coupled with the mounting portion to removably connect the fluid end with the power end, and wherein the first side plate is engaged with the flange of the fluid end and the mounting portion of the power end at the first end of the frac pump and the second side plate is engaged with the flange of the fluid end and the mounting portion of the power end at the second end of the frac pump.

3. The connection assembly of claim 2, wherein each of the first side plate and the second side plate has one of a rectangular shape or a square shape, and wherein a height of each of the first side plate and the second side plate is substantially equal to a height of a flange of the fluid end.

4. The connection assembly of claim 1, wherein each of the first side plate and the second side plate defines a first surface and a second surface opposite the first surface, and wherein the second surface of each of the first side plate and the second side plate faces the plurality of stay rods.

5. The connection assembly of claim 4, wherein the first side plate includes one or more first coupling extensions coupled with the second surface of the first side plate, and wherein each of the one or more first coupling extensions engage with the one or more stay rods that are disposed proximal to the first end to removably couple the first side plate with the one or more stay rods.

6. The connection assembly of claim 5, wherein the one or more first coupling extensions include four first coupling extensions, and wherein each of the four first coupling extensions has an arcuate shape.

7. The connection assembly of claim 1, wherein the second side plate includes one or more second coupling extensions coupled with the second surface of the second side plate, and wherein each of the one or more second coupling extensions engage with the one or more stay rods that are disposed proximal to the second end to removably couple the second side plate with the one or more stay rods.

8. The connection assembly of claim 7, wherein the one or more second coupling extensions include four second coupling extensions, and wherein each of the four second coupling extensions has an arcuate shape.

9. The connection assembly of claim 1, wherein each of the first side plate and the second side plate defines a through-opening to provide visual access to a space defined between the first side plate and the second side plate.

10. The connection assembly of claim 1, further comprising:

a top plate disposed at a top end of the frac pump, wherein the top plate extends between the fluid end and the power end; and a bottom plate disposed at a bottom end of the frac pump, wherein the bottom plate extends between the fluid end and the power end.

11. A frac pump comprising:

a power end;

a fluid end; and a connection assembly that removably connects the fluid end with the power end, the connection assembly including:

a plurality of stay rods extending between the fluid end and the power end to removably connect the fluid end with the power end;

a first side plate disposed at a first end of the frac pump, wherein the first side plate extends between the fluid end and the power end, and wherein the first side plate is removably coupled with one or more stay rods from the plurality of stay rods that are disposed proximal to the first end; and a second side plate disposed at a second end of the frac pump, wherein the second end is longitudinally opposite the first end, wherein the second side plate extends between the fluid end and the power end, and wherein the second side plate is removably coupled with one or more stay rods from the plurality of stay rods that are disposed proximal to the second end.

12. The frac pump of claim 11, wherein the fluid end includes a flange, and wherein the plurality of stay rods are removably coupled with the flange to removably connect the fluid end with the power end, wherein the power end includes a mounting portion, wherein the plurality of stay rods are removably coupled with the mounting portion to removably connect the fluid end with the power end, and wherein the first side plate is engaged with the flange of the fluid end and the mounting portion of the power end at the first end of the frac pump and the second side plate is engaged with the flange of the fluid end and the mounting portion of the power end at the second end of the frac pump.

13. The frac pump of claim 12, wherein each of the first side plate and the second side plate has one of a rectangular shape or a square shape, and wherein a height of each of the first side plate and the second side plate is substantially equal to a height of a flange of the fluid end.

14. The frac pump of claim 11, wherein each of the first side plate and the second side plate defines a first surface and a second surface opposite the first surface, and wherein the second surface of each of the first side plate and the second side plate faces the plurality of stay rods.

15. The frac pump of claim 14, wherein the first side plate includes one or more first coupling extensions coupled with the second surface of the first side plate, and wherein each of the one or more first coupling extensions engage with the one or more stay rods that are disposed proximal to the first end to removably couple the first side plate with the one or more stay rods.

16. The frac pump of claim 15, wherein the one or more first coupling extensions include four first coupling extensions, and wherein each of the four first coupling extensions has an arcuate shape.

17. The frac pump of claim 11, wherein the second side plate includes one or more second coupling extensions coupled with the second surface of the second side plate, and wherein each of the one or more second coupling extensions engage with the one or more stay rods that are disposed proximal to the second end to removably couple the second side plate with the one or more stay rods.

18. The frac pump of claim 17, wherein the one or more second coupling extensions include four second coupling extensions, and wherein each of the four second coupling extensions has an arcuate shape.

19. The frac pump of claim 11, wherein each of the first side plate and the second side plate defines a through-opening to provide visual access to a space defined between the first side plate and the second side plate.

20. The frac pump of claim 11, wherein the connection assembly further includes:

a top plate disposed at a top end of the frac pump, wherein the top plate extends between the fluid end and the power end; and a bottom plate disposed at a bottom end of the frac pump, wherein the bottom plate extends between the fluid end and the power end.

* * * * *